US005680081A

United States Patent [19]

Scheel et al.

[11] Patent Number: 5,680,081

[45] Date of Patent: Oct. 21, 1997

[54] CIRCUIT BREAKER HAVING DOUBLE BREAK MECHANISM

[75] Inventors: Jerry L. Scheel; Randall L. Siebels, both of Cedar Rapids; Matthew D. Sortland, Swisher; John M. Winter; Dale W. Bennett, both of Cedar Rapids, all of Iowa

[73] Assignee: Square D Company, Palatine, Ill.

[21] Appl. No.: 181,289

[22] Filed: Jan. 13, 1994

[51] Int. Cl.[6] ..... H01H 75/00

[52] U.S. Cl. ..... 335/16; 335/147; 335/195; 218/22

[58] Field of Search ..... 335/16, 147, 195; 218/22

[56] References Cited

U.S. PATENT DOCUMENTS

| | | | |
|---|---|---|---|
| 3,943,316 | 3/1976 | Oster . | |
| 3,943,482 | 3/1976 | Oster et al. . | |
| 3,944,953 | 3/1976 | Oster . | |
| 3,946,346 | 3/1976 | Oster et al. | 335/6 |
| 4,417,223 | 11/1983 | Bancalari | 335/195 |
| 4,740,768 | 4/1988 | Morris et al. . | |
| 5,003,139 | 3/1991 | Edds et al. . | |
| 5,073,764 | 12/1991 | Takahashi et al. | 335/16 |
| 5,075,657 | 12/1991 | Rezac et al. . | |
| 5,097,589 | 3/1992 | Rezac et al. . | |
| 5,159,304 | 10/1992 | Yamagata et al. . | |
| 5,245,302 | 9/1993 | Brune et al. . | |

*Primary Examiner*—Lincoln Donovan

*Attorney, Agent, or Firm*—Kareem M. Irfan; Larry I. Golden

[57] ABSTRACT

A circuit breaker includes a first section and a second section with independently operating pairs of contact assemblies in each respective section. In the first section, at least one of the contact assemblies is constructed and arranged to interrupt the current by moving from a normally closed position to a blown-open position and latching with the contact assemblies separated. The second section has a biasing extension spring for biasing the contact assemblies of the second section so as to permit interruption of the current in response to a blow-open force, which causes the contacts to separate only momentarily and then return to a normally closed position. The first and second pairs of contact assemblies separate substantially simultaneously in response to the blow-open force, and only the first section reacts to lower-level over-current conditions. In addition to the contact assemblies, the second section of the circuit breaker is designed to operate using only a spring which is "Z-axis" mountable. Other aspects of the invention include one-piece tripping actuator, a screw retainer assembly for securing the line or load terminal, a bimetal arrangement involving an improved calibration process and an associated stress-reducing line terminal.

40 Claims, 7 Drawing Sheets

CIRCUIT BREAKER HAVING DOUBLE BREAK MECHANISM

FIELD OF THE INVENTION

The present invention relates generally to circuit breakers and, more particularly, to circuit breakers having multiple sets of contacts for interrupting a single current path through the circuit breaker.

BACKGROUND OF THE INVENTION

Use of circuit breakers is widespread in modern-day residential, commercial and industrial electric systems, and they constitute an indispensable component of such systems toward providing protection against over-current conditions. Various circuit breaker mechanisms have evolved and have been perfected over time on the basis of application-specific factors such as current capacity, response time, and the type of reset (manual or remote) function desired of the breaker.

One type of circuit breaker mechanism employs a thermo-magnetic tripping device to "trip" a latch in response to a specific range of over-current conditions. The tripping action is caused by a significant deflection in a bi-metal or thermostat-metal element which responds to changes in temperature due to resistance heating caused by flow of the circuit's electric current through the element. The thermostat metal element is typically in the form of a blade and operates in conjunction with a latch so that blade deflection releases the latch after a time delay corresponding to a predetermined over-current threshold in order to "break" the current circuit associated therewith. Circuit breaker mechanisms of this type often include an electro-magnet operating upon a lever to release the breaker latch in the presence of a short circuit or very high current condition. A handle or push button mechanism is also provided for opening up the electric contacts to the requisite separation width and sufficiently fast to realize adequate current interruption.

Another type of circuit breaker, referred to as a "double-break" circuit breaker, includes two sets of current-breaking contacts to accommodate a higher level of over-current conditions than is accommodated by the one discussed above. One such double-break circuit breaker implements its two sets of contacts using the respective ends of an elongated rotatable blade as movable contacts which meet non-movable contacts disposed adjacent the movable contacts. The non-movable contacts are located on the ends of respective U-shaped stationary terminals, so that an electro-magnetic blow-off force ensues when the current, exceeding the threshold level, passes through the U-shaped terminals. Thus, when this high-level over-current condition is present, the blow-off force causes the elongated rotatable blade to rotate and the two sets of contacts to separate simultaneously.

Another type of double-break circuit breaker implements its two sets of contacts using separate and independent structures. For example, one set of contacts may be implemented using the previously-discussed thermo-magnetic tripping device to trip the current path at low-level current conditions, and the other set of contacts using an intricate and current-sensitive arrangement which separates its contacts in response to high-level blow-off current conditions. See, for example, U.S. Pat. Nos. 3,944,953, 3,96,346, 3,943,316 and 3,943,472, each of which is assigned to the instant assignee.

While providing adequate protection to high-level over-current conditions, such double-break circuit breakers are overly complex, and difficult to manufacture and service.

With respect to their manufacture, for example, the complexity of the control mechanism for separating each set of contacts adds significantly to the overall component part count for the circuit breaker. Consequently, material and assembly costs for such circuit breakers are relatively high.

Double-break circuit breakers also have power-loss disadvantages that are not found in the first-described (single-break) circuit breaker. These double-break circuit breakers typically develop contact resistances which create higher power losses. The power losses fluxuate from one operation to the next, thereby making the double-break circuit breaker unreliable and burdensome to maintain.

Furthermore, initial calibration of such breaker mechanisms during the manufacturing stage is rendered difficult, and the stability of the initial calibration is relatively poor. These calibration problems are due, in large measure, to the high degree of inter-component friction occurring as a result of the plurality of sliding and interacting surfaces associated with the latching mechanism.

Accordingly, there is a need for a double-break circuit breaker that can be implemented without the aforementioned shortcomings.

SUMMARY OF THE INVENTION

The present invention provides a circuit breaker having a double-break current-path interrupting mechanism which overcomes the above-mentioned deficiencies of the prior art.

The present invention further provides a circuit breaker having a double-break current-path interrupting mechanism operating with lower peak currents, lower $I^2t$ energy, and high interruption ratings in a relatively small package.

In one implementation of the present invention, a circuit breaker comprises a first section and a second section. The first section has a first pair of contact assemblies, at least one of which is constructed and arranged to interrupt the circuit breaker's current path by moving from a normally closed position to a blown-open position. Once blown open, it remains latched with the contacts of the contact assemblies separated. The second section has a bias mechanism and a second pair of contact assemblies, at least one of the contact assemblies being constructed and arranged to interrupt the current by momentarily moving from a normally closed position in response to a blow-open force and subsequently returning to the normally closed position via the bias mechanism. The respective first and second pairs of contact assemblies separate in response to the blow-open force substantially simultaneously. The first and second pairs of contact assemblies, along with the bias mechanism, are retained within an enclosure via internal retainment sections.

According to another embodiment of the present invention, a circuit breaker includes a similarly-operating first section, and a second section including a second pair of contact assemblies, at least one of the second pair of contact assemblies being constructed and arranged to pass current during the normal condition and to interrupt the current during the abnormal condition, without the assistance of arc-energy absorption elements electrically connected to either of the contact assemblies of the second pair. A bias mechanism exerts a bias force on the second pair of contact assemblies in a direction to maintain the second pair of contact assemblies in position for passing the current during the normal condition.

In yet another embodiment, a circuit breaker has a conductive stationary mid terminal having a first end in a first section of the circuit breaker and a second end in a second section of the circuit breaker. The first section has a first pair of contact assemblies, one of the contact assemblies including a contact connected to the conductive mid terminal near its first end, and the other of the first pair of contact assemblies including a movable contact moving from a normally closed position to an open position and latching with the contact assemblies separated. The second section has a second pair of contact assemblies, one of which including a contact connected to the conductive mid terminal near its second end, and the other of the second pair of contact assemblies including a movable contact moving from a normally closed position to an open position. An enclosure for the circuit breaker has internal retainment sections constructed and arranged for retaining the first and second pairs of contact assemblies and, at least in part, separating the first and second sections.

Other aspects of the present invention include a one-piece tripping actuator, a screw retainer assembly for securing the line or load terminal, a bimetal arrangement involving an improved calibration process and an associated stress-reducing line terminal.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
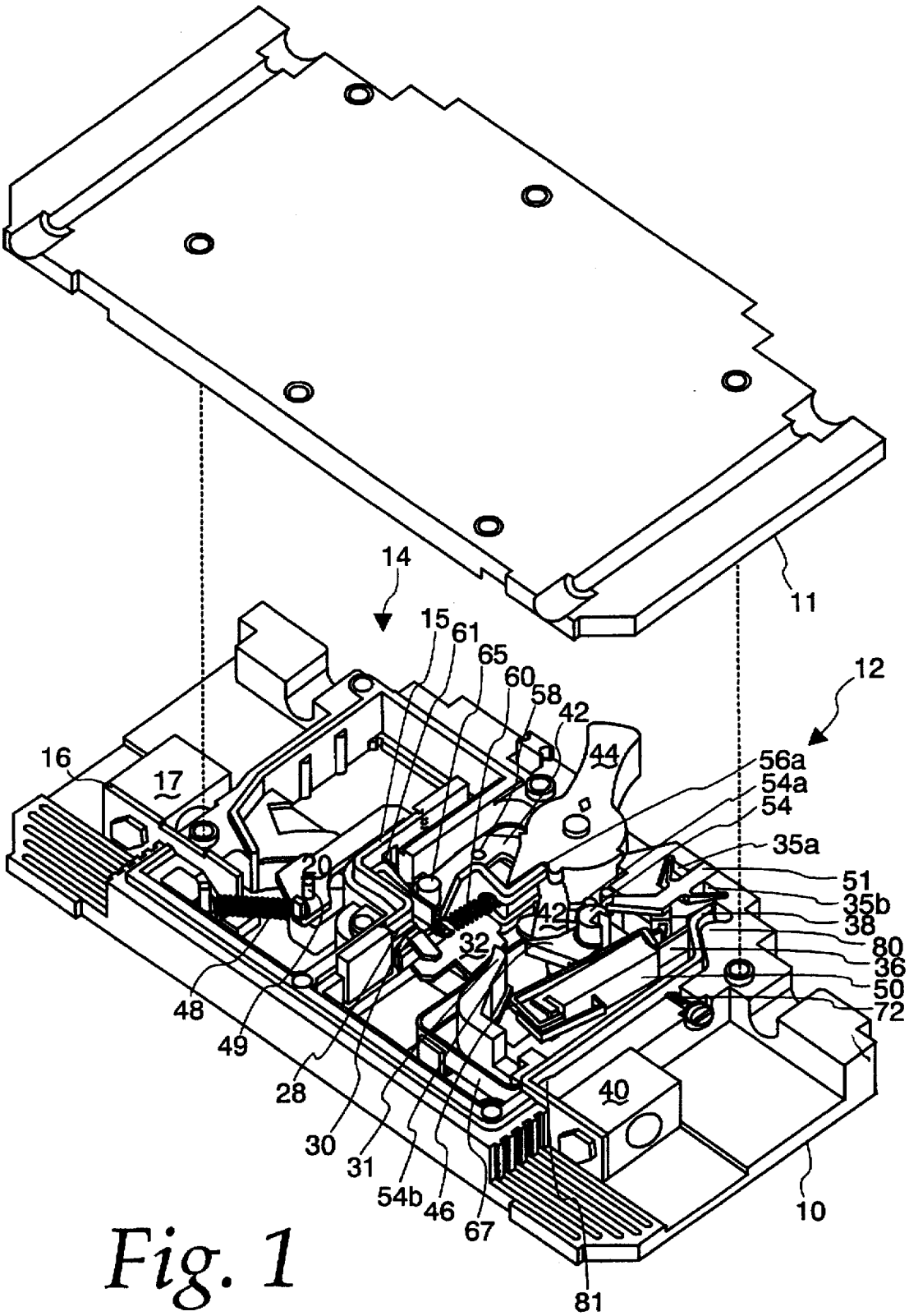
FIG. 1 is an illustration of a circuit breaker, in accordance with the present invention, with the circuit breaker cover removed so as to illustrate the components within the circuit breaker.
Figure 6:
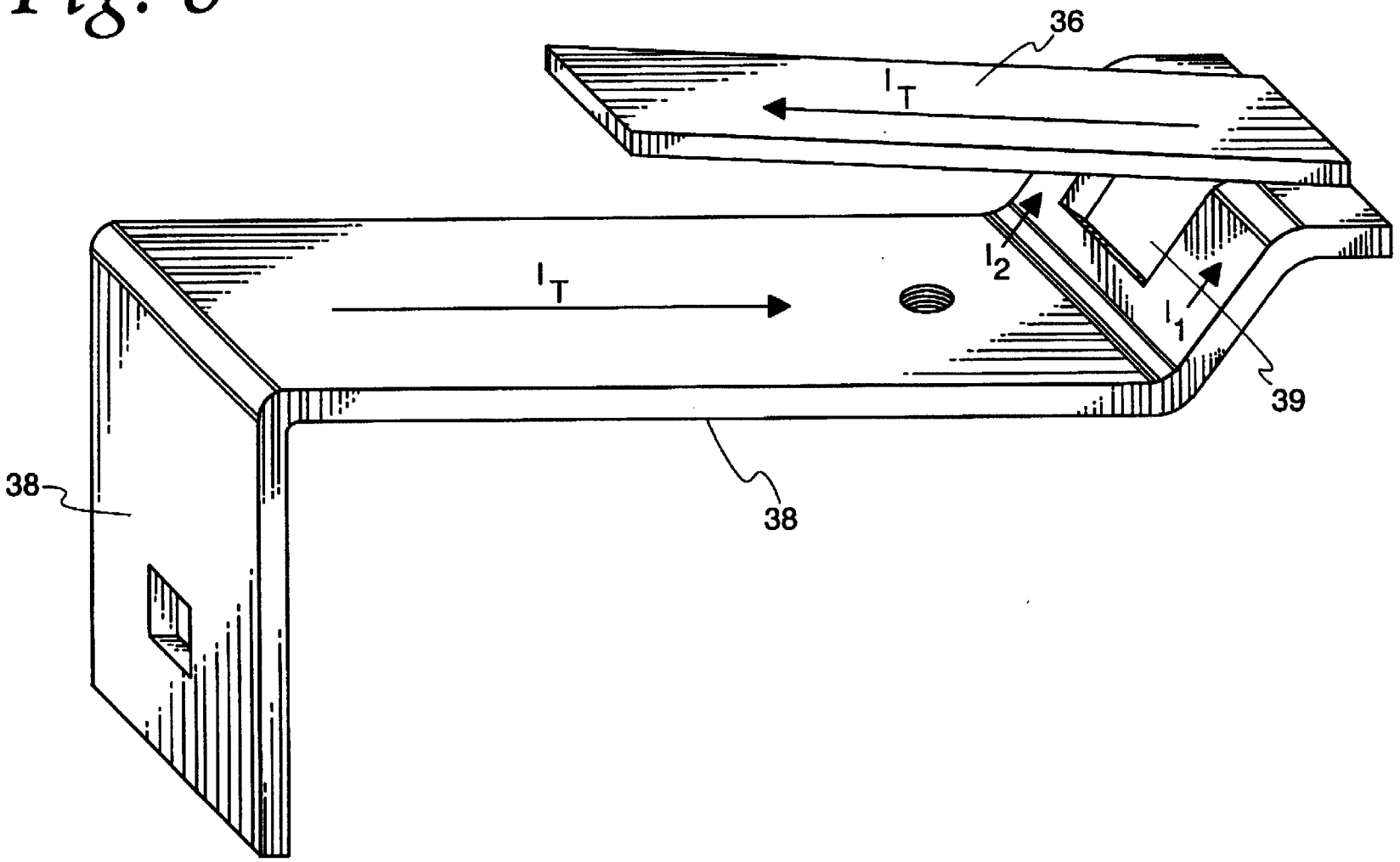
Figure 7:
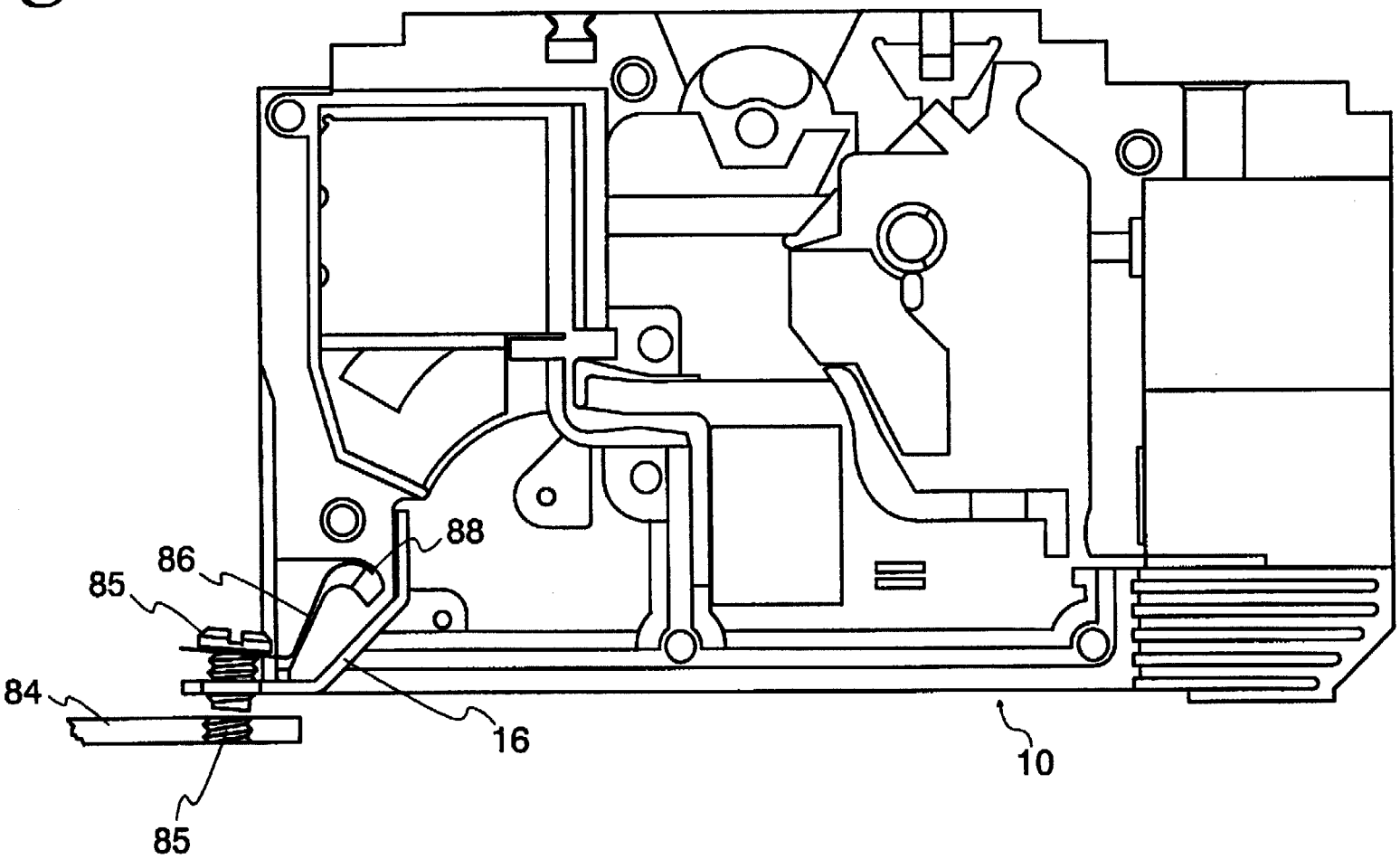

FIGS. *5a* and *5b* are perspective illustrations of the primary blade, according to the present invention, using in the primary contact assemblies of the circuit breaker of FIG. 1;

FIG. 6 is a perspective illustration of a load terminal and a bimetal member, according to the present invention, used in the circuit breaker of FIG. 1; and FIG. 7 is an illustration of a screw retainer arrangement, in accordance with the present invention, which may be used as an alternative to one or both of the line blocks shown in FIG. 1.

While the invention is susceptible to various modifications and alternative forms, specific embodiments thereof have been shown by way of example in the drawings and will be described in detail. It should be understood, however, that it is not intended to limit the invention to the particular form described. On the contrary, the intention is to cover all modifications, equivalents and alternatives falling within the spirit and scope of the invention as defined by the appended claims.

DETAILED DESCRIPTION OF THE FIGURES

While the present invention may be used in a wide variety of residential, commercial and industrial applications, the implementation of the present invention shown in FIG. 1 is ideally suited for applications requiring high performance, low cost, and design simplicity in a small package.

The circuit breaker of FIG. 1 includes an enclosure (including base 10 and cover 11) having numerous component compartments (in the form of molded protrusions) to retain the internal components of the circuit breaker, the majority of which reside in a primary section 12 or in a secondary section 14. While there is no definitive line of distinction between the primary and secondary sections, a conductive mid terminal 15 may be used to delineate generally the components in the primary section 12 (to the right of the mid terminal 15) and the components in the secondary section 14 (to the left of the mid terminal 15).

Figure 2:
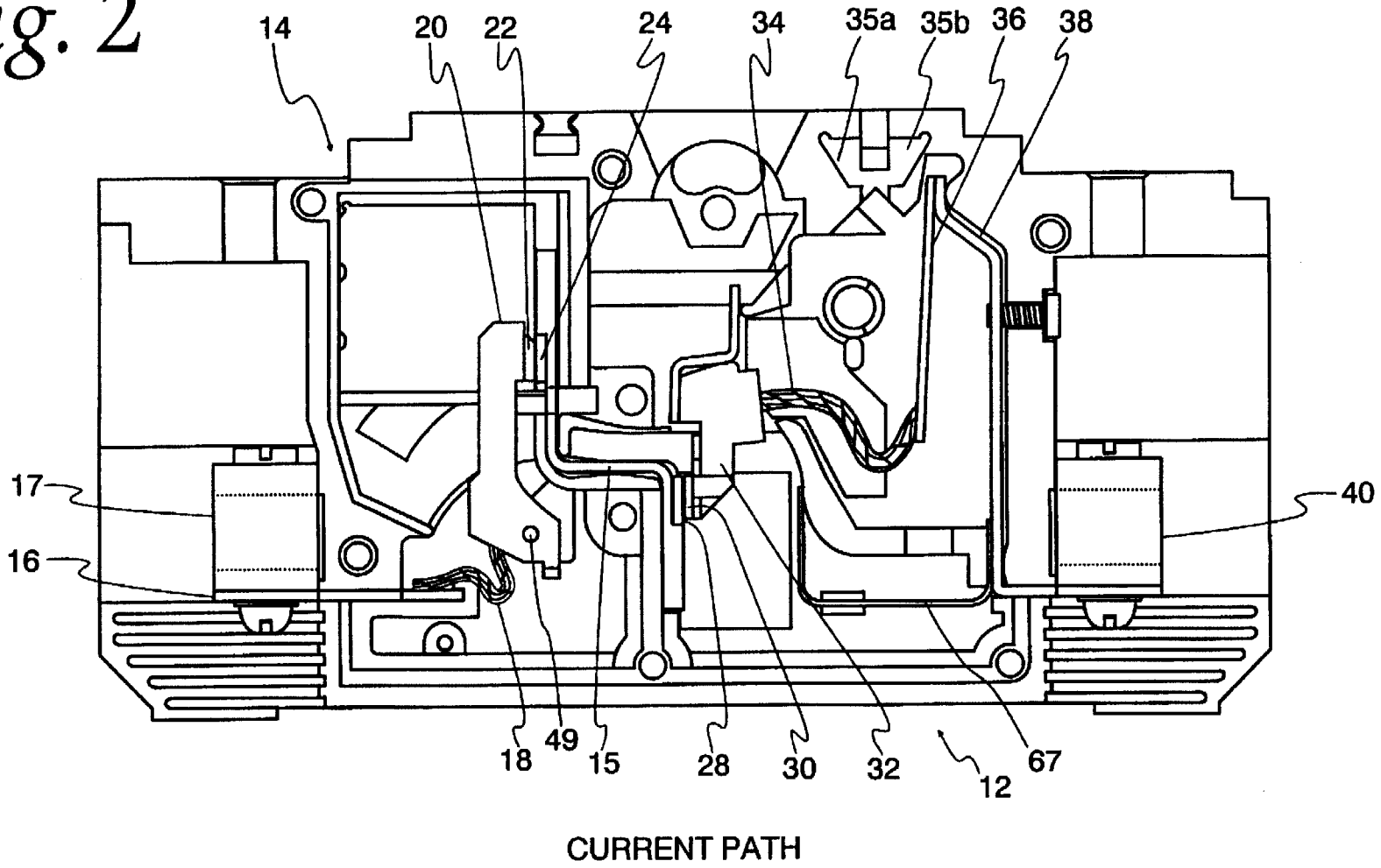
FIG. 2 is an illustration of the circuit breaker of FIG. 1 with certain components removed so as to illustrate the current path through the circuit breaker.

The current path through the circuit breaker is best viewed by referring to FIG. 2, which shows the circuit breaker of FIG. 1 with certain components removed for illustrative purposes. The current path begins within the secondary section 14 at a line terminal 16. The line terminal 16 includes a conventional line block (or lug) 17 for clamping the line wire within an aperture (not shown) therein. From the line terminal 16, a flexible conductor (or pigtail) 18 connects the current path to a rotatable secondary blade 20 which, along with a secondary blade contact 22 and a mating stationary contact 24, are used to establish a pair of contact assemblies for the secondary section 14.

From the stationary contact 24, current flows through the mid terminal 15 to a pair of contact assemblies for the primary section 12, including a stationary contact 28 and a mating rotatable primary blade contact 30. The stationary contact 28 is attached to the lower portion of the mid terminal 15, near its lower end. The mating contact 30 is attached to a primary blade 32, which rotates about a blade pivot 33 in response to a trip mechanism (illustrated and discussed in connection with FIG. 3). Current flows through the stationary and moveable contacts 28 and 30, through the primary blade 32, and into one end of a primary flexible connector (or pigtail) 34. The other end of the primary flexible connector 34 is attached to a bimetal member 36, which provides the thermal tripping characteristics for the circuit breaker. Finally, the current flows from the bimetal member 36 through a load terminal 38 and out of the load end of the circuit breaker via a terminal block (or lug 40).

The mid terminal 15 is "S"-shaped and arranged with respect to the secondary and primary blades 20 and 32 to form a "U"-shape conductive path for each pair of contact assemblies. Such a "U"-shape construction is used to form a sufficiently strong electromagnetic blow-off force to separate each pair of contacts in response to an over-current condition of sufficient magnitude. For further information regarding the manufacture and operation of the mid terminal 15, reference may be made to U.S. patent application Ser. No. 08/181277, entitled "Mid Terminal for a Double Break Circuit Breaker", filed concurrently herewith and assigned to the instant assignee (incorporated herein by reference).

Figure 3:
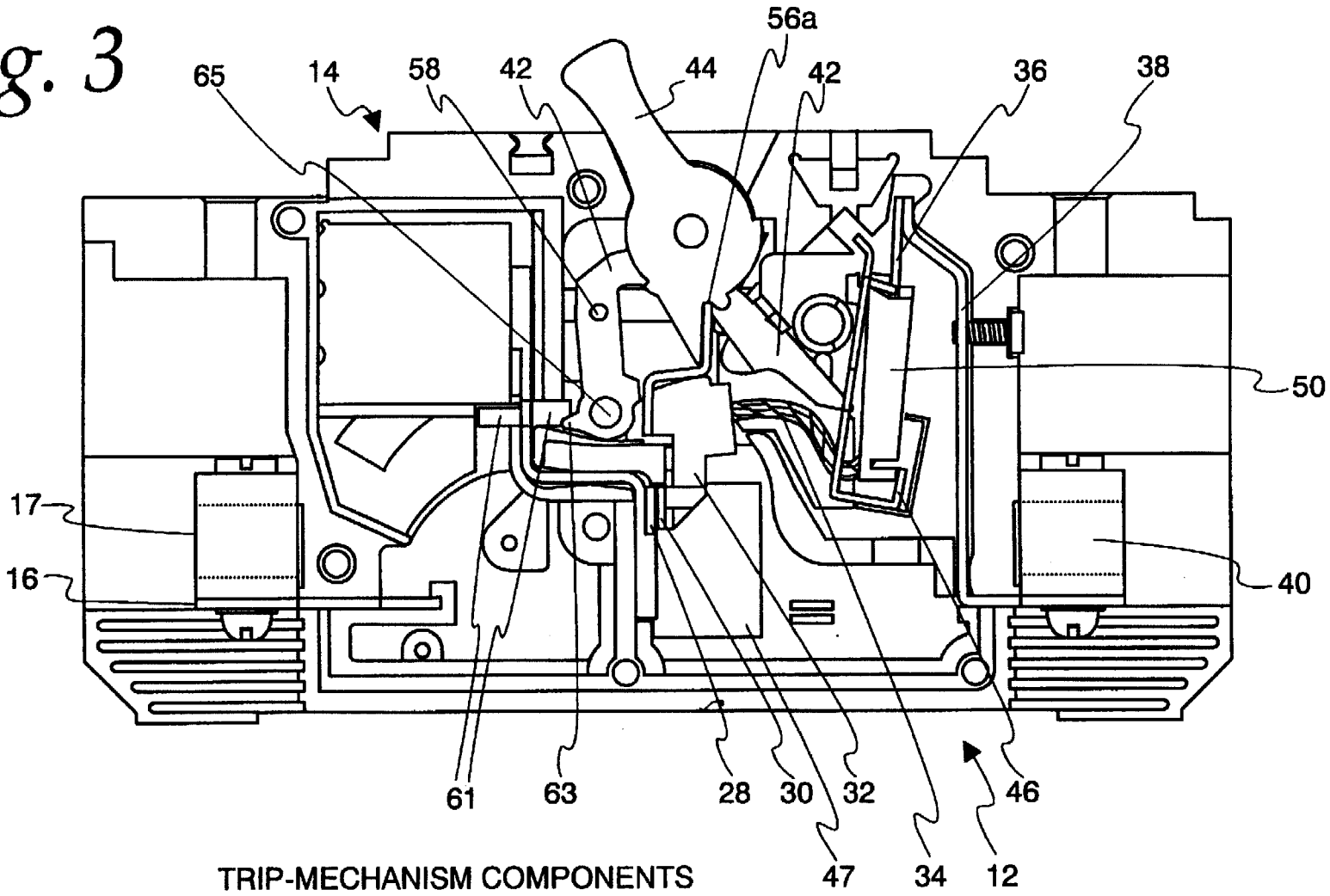
FIG. 3 is an illustration of the circuit breaker of FIG. 1 with certain components removed in order to illustrate the tripping mechanism.

With reference to FIGS. 1 and 3, the primary section of the circuit breaker also includes a trip lever 42, a handle 44, a magnetic armature 46, a primary arc stack 47 and a yoke 50. These components are used to implement the manual ON/OFF operation, the thermal-trip separation, and the electro-magnetic trip separation of the primary contacts 28 and 30.

Figure 5B:
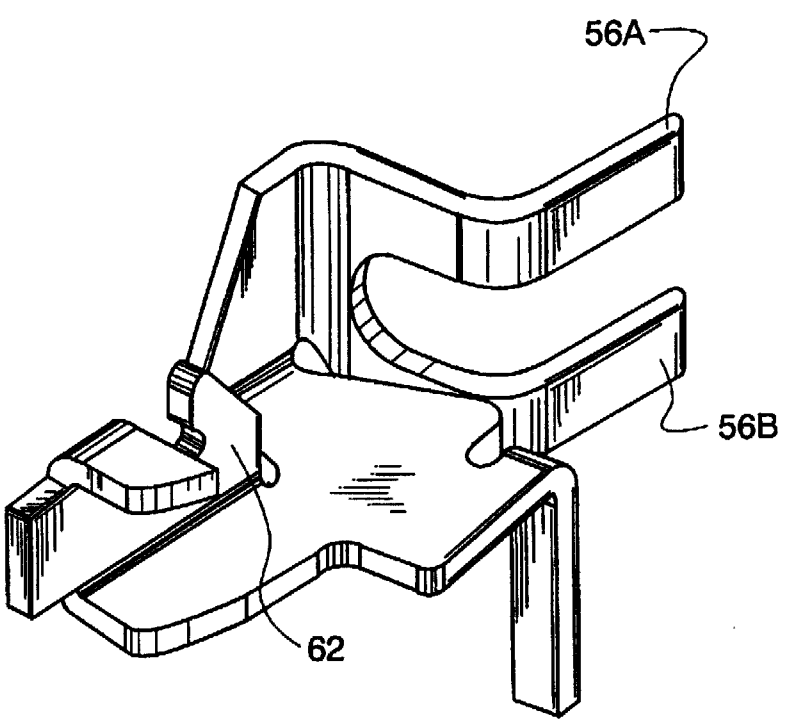
Figure 5A:
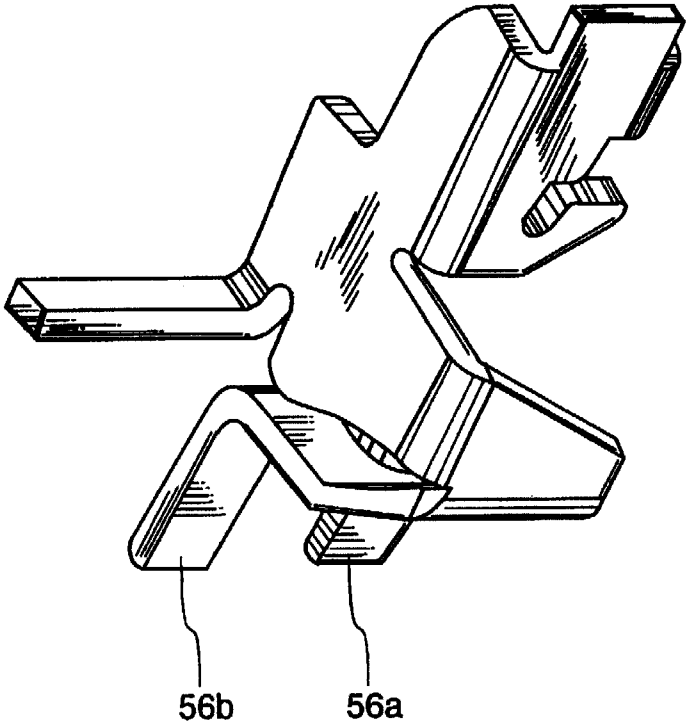

The manual ON and OFF operation of the primary blade 32 occurs in response to the manual rotation of the handle 44 in a clockwise or counterclockwise motion. In response to rotation of the handle 44 in either direction, the primary blade 32 either opens or closes the circuit via the primary moveable contact 30 and the primary stationary contact 28. Rotation of the primary blade 32 is coupled directly to the handle 44 at interface points (or pivots) 56*a* and 56*b* (FIGS. 1 and 5*a*, 5*b*) for the normal ON and OFF operation of the primary blade 32. The secondary section is not affected by the normal ON and OFF operation of the primary blade 32, and the secondary blade contact 22 and the secondary stationary contact 24 remain in the closed position.

The thermal-trip separation of the primary contacts 28 and 30 provides current-interruption capacity for all current-overload levels from zero amperes to approximately 3000 amperes without operational assistance from the secondary section; that is to say, without requiring the secondary section to interrupt with the primary section. The primary section is ready to be tripped when the handle 44 is manually rotated first to the right for latching the trip lever 42 by the magnetic armature 46 and then to the left to turn the circuit breaker "on" (closing the current path). In response to carrying a relatively high level of current, via the bimetal member 36, the magnetic armature 46 is drawn to the yoke 50 to disengage the trip lever 42, thereby causing the trip lever 42 to rotate in the clockwise direction and the primary blade 32 to rotate in the counterclockwise direction to the tripped position. This results in the primary blade contact 30 separating from the stationary contact 28 and interrupting the current flow. Related tripping arrangements are shown in U.S. Pat. Nos. 2,902,560, 3,098,136, 4,616,199, and 4,616,200, each of which is assigned to the instant assignee and incorporated herein by reference.

Figure 4:
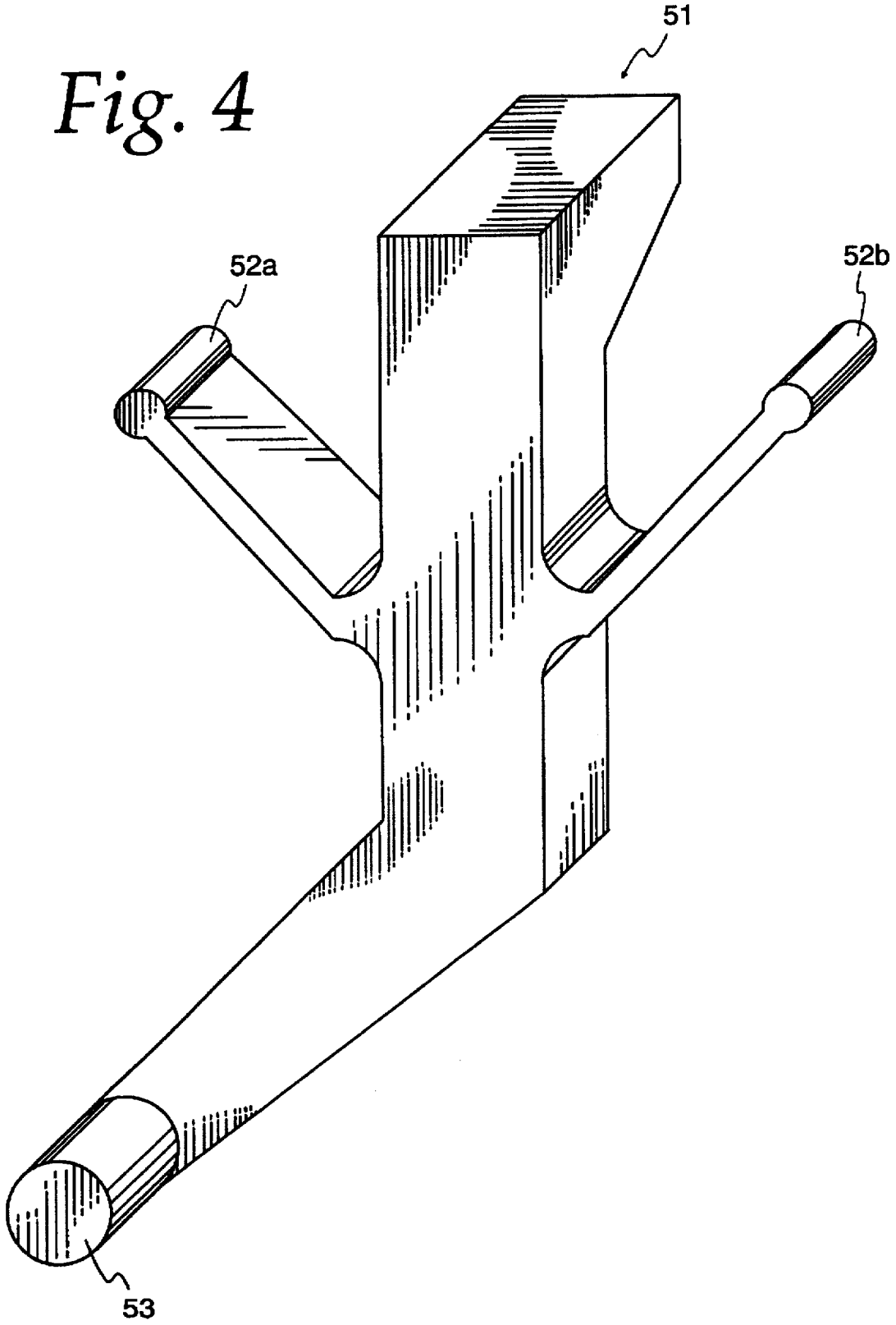
FIG. 4 is an illustration of a plastic one-piece depressible member, according to the present invention, which is used in the circuit breaker of FIG. 1.

The primary contacts 28 and 30 can also be tripped manually, e.g., for testing purposes, by depressing (via an aperture in the top of the enclosure) the top of a plastic one-piece depressible member 51 (FIG. 1). As shown in FIG. 4, the depressible member 51 includes flexible arms 52*a* and 52*b* and an engagement leg 53. The flexible arms 52*a* and 52*b* reside in triangularly-shaped compartments 35*a* and 35*b* (FIG. 2) and, via the walls of these compartments 35*a* and 35*b*, provide resiliency to return the member 51 to its normal position after being depressed. The engagement leg 53 is of sufficient length so that, in response to the depressible member 51 being depressed, the engagement leg 53 engages one wing 54*a* of a cam 54 (FIG. 1) which, in turn, rotates the cam 54 counterclockwise and causes the opposite wing 54*b* to engage the armature 46. This releases the engagement of the trip lever 42 by the armature 46, thereby separating the contacts 28 and 30 via a manually-initiated trip. Because of its arrangement in the enclosure base and its one-piece construction, the depressible member 51 is ideal for manufacture using automated (Z-axis) assembly.

The electro-magnetic blown-open separation of the primary contacts 28 and 30 occurs simultaneously with the separation of the secondary contacts 22 and 24 in the secondary section 14, to provide current-overload protection for levels in excess of about 3000 amperes. In response to the occurrence of a current fault above 3000 amperes, two additive forces develop in opposing directions between each set of contacts, the primary contacts 28 and 30 and the secondary contacts 22 and 24. The first force is the constriction resistance between each set of contacts. This provides a magnetic force that tries to separate the contacts. The second force results from the "U"-shaped current path configuration of the mid terminal 15 in combination with the associated contacts and the primary/secondary blade. This configuration forms a magnetic blowoff loop which creates an additional contact-separation force to separate each set of contacts substantially simultaneously.

Within the primary section 12, the primary blade 32 is biased by an extension spring 60 (FIG. 1), which is secured at one end to a retaining member 62 (FIGS. 5*a*, 5*b*) of the primary blade 32 and at the other end to a retaining member (not shown in FIG. 1) on the trip lever 42. The trip lever 42 is latched by the magnetic armature 46. The handle 44 is used to rotate the primary blade is to the contacts-closed position.

A high level short or fault causes the primary blade 32 to rotate counterclockwise until rotation is stopped by a blade stop 31 (molded as part of the base 10). During this rotation, the blade interface pivots 56*a* and 56*b* (FIGS. 3, 5*a*, 5*b*) remain in the fixed position and, at the same time the blade 32 is blowing open, the trip lever 42 is disengaged and rotating counterclockwise. The handle 44 and the blade interface pivots 56*a* and 56*b* move only after the trip lever 42 has moved sufficiently enough to take the blade 32 out of its toggle position, which occurs after the blade 32 returns to the contacts-closed position.

For further information concerning the primary blade 32, reference may be made to U.S. patent application Ser. No. 08/180690, entitled "High Current Capacity Blade", filed concurrently herewith, assigned to the instant assignee and incorporated herein by reference.

Within the secondary section 14, the collective separating force causes the secondary blade 20 to rotate counterclockwise about a pivot 49 to overcome the force of an extension spring 48 (FIG. 1), causing the extension spring 48 to stretch. The extension spring 48 permits the secondary blade 20 to continue to open as long as the force to open the blade is greater than the extension force of the spring 48. Thus, when the separating force decreases to a level which is less than the extension force of the spring 48, the spring 48 returns the secondary blade 20 to its normally-closed position.

Other than the extension spring 48, the only other component acting upon the secondary blade 20 is an optionally-used kicker 61, which separates the contacts 28 and 30 slightly in response to a "trip" (by trip lever 42) in order to prevent the over-current condition from welding the contacts 22 and 24 together. The kicker 61 is an elongated plastic component residing in a hole through the center of the mid terminal 15, having one end abutting an extension 63 (FIG. 3) on the trip lever 42, and another end abutting the secondary blade 20 just below the secondary contact 22. Thus, in response to a tripped condition, the trip lever 42 rotates about a pivot 65 causing the extension 63 to engage the kicker 61 which, in turn, responds by striking the secondary blade 20 and maintaining it an insubstantial distance (about 0.025 inch) away from its normally-closed position. For additional information concerning the structure and operation of the kicker 61 and the extension spring 48, as well as alternative implementations therefor, reference may be made to U.S. patent application Ser. No. 08/181522, entitled "Double Break Circuit Breaker Having Improved Secondary Section", filed concurrently herewith, assigned to the instant assignee and incorporated herein by reference.

The spring 48 and the blade 20 are therefore the only substantially active components in the secondary section, and this two-component arrangement requires no traditional current limiting components connected to the blade 20 to absorb arc-energy current resulting from a separation of the contacts 22 and 24. Rather, this current is minimized by the simultaneous separation of the contacts in the primary section. The arc energy developing between the contacts of the secondary section is absorbed by a secondary are stack (not shown).

Within the primary section 12, the arc voltage that is generated as the primary contacts 28 and 30 are separated is guided out of the circuit breaker by an arc-transfer blade 67, a primary arc stack (not shown) and an arc-reflecting slide-fiber element (not shown). The blade 67 is positioned close enough to the sweeping radius of the contact 30 so that it can accommodate lower level fault currents in the circuit breaker, which is important because the secondary blade does not operate in response to lower-level faults. As the contact 30 passes next to the closest part of the arc-transfer blade 67, the arc jumps to the surface of the blade 87, which provides the arc with a linear path through the arc stack and prevents the arc from trying to reignite between the contacts 28 and 32. Thus, the arc energy is guided out to the load terminal 38 along the arc-transfer blade 67. At higher energy levels, the arc-transfer blade 67 reduces the stress on the bimetal member 36 by diverting the current therefrom and onto the arc-transfer blade 67. The slide fiber 69 produces gaseous ions which help to drive the arc energy into the arc stack 68.

Because both sets of contacts separate simultaneously, the combination of the arc voltages within the secondary arc stack 66 and the primary arc stack 68 results in these arc voltages being additive. This provides a very fast rise of are voltage and also allows high levels of arc voltage to be generated within the disclosed circuit breaker, as required in many applications in need of double break circuit breakers.

For further information concerning the primary and secondary arc stacks 66 and 68 and the manner in which arc energy is shunted from between the contacts, reference may be made to U.S. patent application Ser. Nos. 08/181288 and 08/181290, respectively entitled "Arc Stack for a Circuit Breaker" and "Blade Transfer Arc Shunt", filed concurrently herewith, assigned to the instant assignee and also incorporated herein by reference.

Calibration of the thermal tripping characteristics is performed by adjusting a calibration screw 72 (FIG. 1) to set the proper position for the bimetal member 36. The load terminal 38 is connected to the bimetal member 36 so that when the calibration screw 72 is turned in a clockwise direction, the calibration screw 72 pulls the middle of the load terminal 38 towards the head of the calibration screw 72. As the load terminal 38 is being pulled in its center area, the connection point between the load terminal 38 and the bimetal member 36 offers resistance to the calibration force. Consequently, the load terminal 38 begins to bow in its center section between a pair of bridge points 94 and 95, and both the yoke 50 and the armature 46 move towards the load terminal 38. As the armature 46 moves in this direction, the latch engagement point for the trip lever 42 is adjusted to the proper calibration.

The span of the two bridge points 80 and 81 is increased with respect to prior art structures to provide another significant improvement. It has been discovered for example, that by creating a larger span (no less than about 2.5 inches), the amount of force and stress on the thermoset bakerite material of the enclosure retainment protrusions is decreased dramatically, because the bending of the load terminal 38 by the calibration screw 72 occurs farther away from the point of movement. With less stress on the bridge points 80 and 81 and relatively little stress under the calibration screw 72, the calibration stability of the circuit breaker is increased significantly.

The ability to calibrate the circuit breaker is also enhanced by this construction. The widened span between the bridge points 80 and 81 allows less sensitivity to changes in the calibration screw rotation thereby making it easier to calibrate during manufacturing of the circuit breaker.

Referring now to FIG. 6, the load terminal 38 and the bimetal member 36 are constructed and arranged to minimize stress in this area of the circuit breaker. As the current (It) flows through the junction joining the load terminal 38 and the bimetal member 36, the current (It) turning thereat generates electro-magnetic forces in opposing directions and transverse to the directions of the current (It). The stress these opposing forces can exert a stress on the junction joining the load terminal 17 and the bimetal member 36 can adversely affect the thermal tripping characteristics of the circuit breaker after a short circuit. In accordance with the present invention, this problem is overcome by maintaining a substantial distance (about 0.40 inch at center) between the load terminal 38 and the bimetal member 36 and, more importantly, by splitting the current in the load terminal 38 around a hole 39 therein located directly adjacent the junction. This hole 39 significantly reduces the magnetic field to allow higher peak currents through the components with no lost trip-out or recalibration problems after short circuit interruptions. When the current splits and goes to the outside of the load terminal 38, it decreases the amount of magnetic flux directly below the bimetal member 36. The current then enters the interface junction and moves into the bimetal member 36. Since the magnetic field is reduced by the hole in the terminal the current flowing back in the bimetal member 36 in the opposite direction results in a magnetic blowoff force that is significantly less in terms of over stressing the load terminal 38 as well as the bimetal member 36.

In FIG. 7, an alternative to using the conventional line block 17 (equally applicable for the load block 40) to connect to the an external panel terminal 84 is shown in the form of a screw retainer assembly, with the associated corner of the enclosure modified as shown to expose the screw 85 for connecting the line terminal 16 to the panel terminal 84. The screw 85 is secured into a screw retainer 86 via a threaded hole therein. The screw retainer 86 can be implemented using a thin flexible metal ribbon having a hole therein shaped to surround the threads of the screw 85 and a shoulder 88 at one end thereof to be retained within the pocket of the enclosure. The screw retainer 86 is shaped such that one side thereof is loosely retained within a pocket formed by the cover and base of the circuit breaker enclosure. The screw 85 is allowed to flex up and be positioned as to easily thread the screw into the panel terminal 84. The screw retainer 86 is allowed to move up into the circuit breaker pocket but is stopped at a point by the termination of the cavity in the back of the pocket. By stopping the retainer at this point and by using the walls of the pocket to retain the shoulder 88, the retainer 86 is loosely secured within the pocket. This construction, which is ideal for manufacture using Z-axis automated equipment, allows the ease of attachment of the screw to the line terminal especially when there are multiple circuit breaker poles to simultaneously attach to the panelboard terminals.

Accordingly, a double break circuit breaker has been disclosed, embodying the principles of the present invention, which provides high-end performance in terms of interruption with independent operation of primary and secondary blades for a simple design and better resistance stability when used in switching tests. The overall impact is lower product cost at higher performance than any previous circuit breaker design.

Those skilled in the art will readily recognize that various modifications and changes may be made to the present invention without departing from the true spirit and scope thereof, which is set forth in the following claims.

What is claimed is:

1. A circuit breaker for passing current during a normal condition and, in response to an abnormal condition, interrupting the current, comprising:

a first section having a first pair of contact assemblies, at least one of the contact assemblies being constructed and arranged to interrupt the current by moving from a normally closed position to a blown-open position and latching with the contact assemblies separated;

a second section having a bias mechanism and a second pair of contact assemblies, at least one of the contact assemblies being constructed and arranged to interrupt the current by momentarily moving from a normally closed position in response to said abnormal condition in which an overload current results in electromagnetic forces simultaneously acting on said first and second pair of contact assemblies, said one pair of the contact assemblies returning to the normally closed position in response to a biasing force entered by the bias mechanism, said first and second pairs of contact assemblies separating substantially simultaneously in response to said electromagnetic forces resulting from said overload current flowing between said first and second pair of contact assemblies; and an enclosure having internal retainment sections constructed and arranged for retaining the first and second pairs of contact assemblies and the bias mechanism.

2. A circuit breaker, according to claim 1, wherein the first section further includes a trip mechanism and said at least one of the contact assemblies moves in response to the trip mechanism upon detection of a trip condition.

3. A circuit breaker, according to claim 2, further including a conductive plate having a first portion constructed and arranged as part of the first pair of contact assemblies and having a second portion being constructed and arranged as part of the second pair of contact assemblies.

4. A circuit breaker, according to claim 1, wherein the bias mechanism includes only one spring coupled to said at least one of the contact assemblies of the second pair.

5. A circuit breaker, according to claim 1, wherein the bias mechanism includes a spring.

6. A circuit breaker, according to claim 1, wherein the bias mechanism is an extension spring.

7. A circuit breaker, according to claim 1, wherein the second pair of contact assemblies separate a substantial distance from one another solely in response to the blow-open force.

8. A circuit breaker, according to claim 1, wherein the first and second sections are substantially isolated from one another, at least in part, by a portion of the circuit breaker housing.

9. A circuit breaker for passing current during a normal condition and, in response to an abnormal condition, interrupting the current, comprising:

a first section having a first pair of contact assemblies, at least one of the contact assemblies being constructed and arranged to interrupt the current by moving from a normally closed position to an open position and latching with the contact assemblies separated; and a second pair having:

a second pair of contact assemblies, at least one of the second pair of contact assemblies being constructed and arranged to pass current during the normal condition and interrupt the current during the abnormal condition in which an overload current results in electromagnetic forces simultaneously acting on said first and second pair of contact assemblies to separate substantially simultaneously said first and second pair of contact assemblies, with no arc-energy absorption elements electrically connected to either of the contact assemblies of the second pair, and a bias mechanism exerting a bias force in a direction to maintain the second pair of contact assemblies in position for passing the current during the normal condition.

10. A circuit breaker, according to claim 9, further including an arc shunt block arranged for absorbing energy discharged in response to an interruption of the current in the second section.

11. A circuit breaker, according to claim 9, wherein the bias mechanism includes a spring.

12. A circuit breaker, according to claim 9, wherein the bias mechanism is an extension spring.

13. A circuit breaker, according to claim 12, wherein the second pair of contact assemblies includes a movable contact arm, and the extension spring is connected to a stationary member at one end and connected to the movable contact arm at the another end.

14. A circuit breaker, according to claim 13, further including an arc shunt block arranged for absorbing energy discharged in response to an interruption of the current in the second section.

15. A circuit breaker for passing current during a normal condition and, in response to at least one abnormal condition, interrupting the current, comprising:

a conductive stationary mid terminal having a first end and a second end;

a first section having a first pair of contact assemblies, one of the contact assemblies including a contact connected to the conductive mid terminal near its first end, and the other of the first pair of contact assemblies including a movable contact moving from a normally closed position to an open position and latching with the contact assemblies separated; and a second section having a second pair of contact assemblies, one of the second pair of contact assemblies including a contact connected to the conductive mid terminal near its second end, and the other of the second pair of contact assemblies including a movable contact moving from a normally closed position to an open position; and an enclosure having internal retainment sections constructed and arranged for retaining the first and second pairs of contact assemblies and, at least in part, separating the first and second sections, said conductive mid terminal is used to form blow-open forces between said first and second pair of contact assemblies.

16. A circuit breaker, according to claim 15, wherein the conductive stationary mid terminal includes one portion within the first section and another portion within the second section.

17. A circuit breaker, according to claim 15, wherein the first section includes a tripping device constructed and arranged to cause the first pair of contact assemblies to separate in response to an over-current level exceeding a first threshold.

18. A circuit breaker, according to claim 17, wherein the second pair of contact assemblies is constructed and arranged to separate in response to an over-current level exceeding a second threshold that is greater than the first threshold.

19. A circuit breaker, according to claim 18, wherein the respective contact assemblies of the first and second sections separate substantially simultaneously in response to a blow-upon current condition in which the over current level exceeds the second threshold.

20. A circuit breaker, according to claim 18, wherein the second section includes an arc shunt block.

21. A circuit breaker, according to claim 18, wherein the second section includes a bias mechanism biasing the contacts of the second pair of contact assemblies toward each other.

22. A circuit breaker, according to claim 20, wherein the second section includes a bias mechanism biasing the contacts of the second pair of contact assemblies toward each other.

23. A circuit breaker for passing current during a normal condition and, in response to an abnormal condition, interrupting the current, comprising:

a pair of contact assemblies, at least one of the contact assemblies being constructed and arranged to interrupt the current by moving from a normally closed position to a tripped position and latching with the contact assemblies separated;

a tripping mechanism manually latched and manually or automatically unlatched causing the pair of contact assemblies to interrupt the current by moving to the tripped position;

an enclosure containing the pair of contact assemblies and the tripping mechanism and having walls defining an aperture to provide access to the tripping mechanism from a location outside the enclosure; and a manually engageable member, located in the aperture, having a first end manually engageable from the location outside the enclosure, having a second end located adjacent the tripping mechanism for unlatching the tripping mechanism, and having opposing resilient arms engaging the walls of the aperture and biasing the member in a direction away from the tripping mechanism, the manually engageable member unlatching the tripping mechanism by responding to manual engagement at its upper end, moving toward and engaging the tripping mechanism at the lower end and automatically returning to a position away from the tripping mechanism upon completion of the manual engagement without latching said tripping mechanism.

24. A circuit breaker, according to claim 23, wherein the enclosure includes a cover portion and a base portion and the aperture is at least partly defined in the base portion.

25. A circuit breaker, according to claim 23, wherein the manually engageable member is a one-piece plastic part.

26. A circuit breaker, according to claim 23, further including a cam, located between the manually engageable member and the tripping mechanism such that the tripping mechanism is unlatched by the manually engageable member via the cam.

27. A circuit breaker, according to claim 26, wherein the tripping mechanism includes a trip lever latched on a yoke, the yoke being arranged adjacent the cam such that the cam engages the yoke to unlatch the tripping mechanism.

28. A circuit breaker for passing current during a normal condition and, in response to an abnormal condition, interrupting the current, comprising:

a pair of contact assemblies, at least one of the contact assemblies being constructed and arranged to interrupt the current by moving from a normally closed position to a tripped position and latching with the contact assemblies separated;

a tripping mechanism manually latched and manually or automatically unlatched causing the pair of contact assemblies to interrupt the current by moving to the tripped position;

an enclosure including a cover portion and a base portion, the enclosure containing the pair of contact assemblies and the tripping mechanism and having walls defining an aperture providing access to the tripping mechanism from a location outside the enclosure; and a one-piece manually engageable member, located in the aperture, having a first end manually engageable from the location outside the enclosure, having a second end located adjacent the tripping mechanism for unlatching the tripping mechanism, and having opposing resilient arms engaging the walls of the aperture and biasing the member in a direction away from the tripping mechanism, the one-piece manually engageable member unlatching the tripping mechanism by responding to manual engagement at its upper end, moving toward and engaging the tripping mechanism at the lower end and automatically returning to a position away from the tripping mechanism upon completion of the manual engagement without latching the tripping mechanism.

29. A circuit breaker, according to claim 28, further including a cam, located between the manually engageable member and the tripping mechanism such that the tripping mechanism is unlatched by the manually engageable member via the cam, and wherein the tripping mechanism includes a trip lever latched on a yoke, the yoke being arranged adjacent the cam such that the cam engages the yoke to unlatch the tripping mechanism.

30. A circuit breaker for passing current from one terminal to another terminal during a normal condition and, in response to an abnormal condition, interrupting the current, comprising:

a pair of contact assemblies, at least one of the contact assemblies being constructed and arranged to interrupt the current by moving from a normally closed position to a tripped position and latching with the contact assemblies separated;

a flexible planar sheet having a hole therein for retaining a screw over one of the terminals and, at an end thereof, having a retainment shoulder;

an enclosure including a cover portion and a base portion, the enclosure containing the pair of contact assemblies and having walls in the base portion at least partly defining the aperture for containing the retainment shoulder of the flexible planar sheet, the enclosure securing the flexible planar sheet so that the screw is retained thereby for securing said one of the terminals to an external conductive member.

31. A circuit breaker, according to claim 30, wherein the walls are constructed and arranged to secure the flexible planar sheet loosely.

32. A circuit breaker, according to claim 30, wherein the flexible planar sheet is metal.

33. A circuit breaker for passing current from one terminal to another terminal during a normal condition and, in response to an abnormal condition, interrupting the current, comprising:

an elongated terminal plate electrically connected to at least one of terminals;

a pair of contact assemblies, at least one of the contact assemblies being constructed and arranged to interrupt the current by moving from a normally closed position to a tripped position and latching with the contact assemblies separated;

a tripping mechanism latched manually and unlatched automatically causing the pair of contact assemblies to interrupt the current by moving to the tripped position, the tripping mechanism including an elongated bimetal member having one end attached to the elongated terminal plate so as to form a junction between the elongated bimetal member and the elongated terminal plate, the elongated bimetal member and the elongated terminal plate having respective portions thereof arranged such that current carried through the junction generates opposing electro-magnetic forces in a direction transverse to the respective portions; and the junction including a current resistant section causing the current to separate into a plurality of current paths so as to reduce the opposing electro-magnetic forces.

34. A circuit breaker, according to claim 33, wherein the current resistant section includes an aperture.

35. A circuit breaker, according to claim 33, wherein the current resistant section is part of the elongated terminal plate.

36. A circuit breaker, according to claim 33, wherein the respective portions of the elongated bimetal member and the elongated terminal plate are arranged substantially parallel to one another.

37. A circuit breaker, according to claim 33, wherein the current resistant section includes an aperture in the elongated terminal plate, and the respective portions of the elongated bimetal member and the elongated terminal plate are arranged substantially parallel to one another.

38. A circuit breaker for passing current from one terminal to another terminal during a normal condition and, in response to an abnormal condition, interrupting the current, comprising:

an enclosure having a plurality of enclosure walls and support members;

a pair of contact assemblies, at least one of the contact assemblies being constructed and arranged to interrupt the current by moving from a normally closed position to a tripped position and latching with the contact assemblies separated;

an elongated terminal plate electrically connected to at least one of terminals and located adjacent one of the enclosure walls;

a tripping mechanism latched manually and unlatched automatically causing the pair of contact assemblies to interrupt the current by moving to the tripped position, the tripping mechanism including an elongated bimetal member having one end attached to the elongated terminal plate so as to form a junction between the elongated bimetal member and the elongated terminal plate, the elongated bimetal member and the elongated terminal plate having respective portions thereof arranged such that current carried through the junction generates opposing electro-magnetic forces in a direction transverse to the respective portions;

a first one of the enclosure support members abutting the elongated terminal plate adjacent the junction on one side of the elongated terminal plate;

a second one of the enclosure support members abutting the elongated terminal plate arranged on said one side of the elongated terminal plate and located no less than about 2.5 inches from the location of the first one of the enclosure support members;

a calibration adjuster, contacting both the elongated metal plate and said one of the enclosure walls, for setting the thermal tripping characteristics of the elongated bimetal member, the calibration adjuster manually engaged to move the bimetal member with respect to the elongated terminal plate.

39. A circuit breaker, according to claim 38, wherein the elongated terminal plate includes a current resistant section causing the current to separate into a plurality of current paths so as to reduce the opposing electro-magnetic forces.

40. A circuit breaker, according to claim 38, wherein the calibration adjuster includes a threaded screw.

* * * * *